United States Patent [19]

Taki et al.

[11] Patent Number: 4,666,666

[45] Date of Patent: May 19, 1987

[54] CORROSION-RESISTANT TITANIUM-BASE ALLOY

[75] Inventors: Kazuhiro Taki; Hideo Sakuyama, both of Toda, Japan

[73] Assignee: Nippon Mining Co., Ltd., Tokyo, Japan

[21] Appl. No.: 796,839

[22] Filed: Nov. 12, 1985

[30] Foreign Application Priority Data

| | | | |
|---|---|---|---|
| Nov. 22, 1984 | [JP] | Japan | 59-246317 |
| Nov. 22, 1984 | [JP] | Japan | 59-246318 |
| Feb. 21, 1985 | [JP] | Japan | 60-31504 |
| Feb. 21, 1985 | [JP] | Japan | 60-31505 |

[51] Int. Cl.[4] ..... C22C 14/00

[52] U.S. Cl. ..... 420/421; 420/417

[58] Field of Search ..... 420/417, 418, 419, 420, 420/421

[56] References Cited

U.S. PATENT DOCUMENTS

| | | | |
|---|---|---|---|
| 3,063,835 | 11/1962 | Stern | 420/417 |

FOREIGN PATENT DOCUMENTS

| | | | |
|---|---|---|---|
| 653938 | 4/1965 | Belgium | 420/419 |
| 657872 | 2/1963 | Canada | 420/421 |
| 1289992 | 2/1969 | Fed. Rep. of Germany | 420/419 |
| 37513 | 4/1978 | Japan | 420/417 |
| 161746 | 9/1983 | Japan | 420/417 |
| 406929 | 11/1973 | U.S.S.R. | 420/418 |

*Primary Examiner*—L. Dewayne Rutledge
*Assistant Examiner*—Robert L. McDowell
*Attorney, Agent, or Firm*—Seidel, Gonda, Goldhammer & Abbott

[57] ABSTRACT

An excellently corrosion-resistant titanium-base alloy comprises, all by weight, either from 0.005% to less than 0.2% ruthenium or from 0.005% to 2.0% palladium or both, at least one of from 0.01% to 2.0% nickel, from 0.005% to 0.5% tungsten, and from 0.01% to 1.0% molybdenum, and the remainder titanium and unavoidable impurities.

1 Claim, No Drawings

CORROSION-RESISTANT TITANIUM-BASE ALLOY

BACKGROUND OF THE INVENTION

This invention rleates to an excellently corrosion-resistant titanium-base alloy.

Titanium has come into extensive use as an industrial material, replacing conventional corrosion-resistant materials by dint of its greater corrosion resistance. It is particularly resistant to corrosive attacks of oxidizing environments such as of nitric acid, chromic acid, chloric acid, chlorine dioxide, and chlorate. Also, it is inert to sea water and other chloride-containing corrosive environments. In a non-oxidizing acid such as hydrochloric or sulfuric acid, however, titanium fails to prove as anticorrosive as in above said environments. Efforts to overcome this disadvantage have led to the introduction of its alloys, typically Ti-Pd, Ti-Ni, and Ti-Ni-Mo alloys, in some sectors of industry. The Ti-Pd alloy is high-priced because it uses expensive palladium, whereas the Ti-Ni and Ti-Ni-Mo alloys have a common drawback of poor workability. These drawbacks have hampered widespread use of the titanium alloys.

Thus, much remains to be settled before successful employment of titanium in severely corrosive environments despite the excellent corrosion resistance inherent to the metal element. Titanium alloys developed to attain partial improvements in this respect have not proved satisfactory either, with many shortcomings yet to be corrected.

SUMMARY OF THE INVENTION

The present invention has now been perfected with the foregoing in view. It is directed to a titanium-base alloy which exhibits a profound anticorrosive effect in rigorously corrosive environments not only of oxidizing acids such as nitric acid but also, and in particular, of non-oxidizing acids. The alloy is, moreover, resistant outstandingly to the crevice corrosion that frequently occurs in solutions wherein chlorine ions are present.

The alloy is a titanium-base alloy of a composition containing one or two of from 0.005% to less than 0.2% by weight ruthenium and from 0.005% to 2.0% by weight palladium and one or more of from 0.01% to 2.0% by weight nickel, from 0.01% to 1.0% by weight molybdenum, and from 0.005% to 0.5% by weight tungsten.

DETAILED DESCRIPTION

In the composition according to the present invention, the ruthenium content has the lower limit fixed at 0.005 wt% because a smaller ruthenium proportion brings a too slight improvement in corrosion resistance for practical purposes. More then 0.005 wt%, preferably more than 0.01 wt%, is required. The upper limit of less than 0.2 wt% is set because a larger addition is uneconomical in that the anticorrosive effect is saturated and the ruthenium cost increases non-negligibly.

The minimum amount of palladium is specified to be 0.005 wt% because a less amount of the element is of little practical significance in improving the corrosion resistance. An amount of at least 0.005 wt%, preferably at least 0.01 wt%, is needed. The maximum palladium amount is specified to be 2.0 wt%. Saturation of the anticorrosive effect and the high palladium cost make a larger addition economically unjustified.

Nickel should be used in an amount of at least 0.01 wt%. When added in a smaller amount, it will not improve the corrosion resistance to a practically beneficial degree. Preferably, at least 0.1 wt% nickel is added. On the other hand, the nickel amount should not exceed 2.0 wt%. A greater nickel proportion adds little to the anticorrosive effect but renders the resulting alloy difficult to work and fabricate. A nickel amount of 1.0 wt% or less is preferred.

The lower limit of the molybdenum content is 0.01 wt%. The addition below this limit is impractical, with a negligible improvement in corrosion resistance. The upper limit of 1.0 wt% is placed because more molybdenum no longer produces an appreciable improvement but rather reduces the workability of the alloy, making it difficult to fabricate.

For tungsten the lower limit of 0.005 wt% is fixed since the addition below this limit is little contributory to the corrosion resistance and is impractical. A preferred amount is 0.01 wt% or more. The upper limit of 0.5 wt% is set on the grounds that a larger percentage of tungsten creates little more favorable effect but decreases the workability and presents difficulty of fabrication.

Next, the effectiveness of the titanium alloy according to the present invention will be explained below in comparison with conventional corrosion-resistant titanium alloys.

The corrosive environments used for tests were, for general corrosion tests, 1. 1% $H_2SO_4$, boiling, and
2. 5% HCl, boiling, and for crevice corrosion tests,
3. 10% NaCl, pH=6.1, boiling.

Table 1 summarizes the results of the tests carried out using 1% $H_2SO_4$.

Among the materials tested, pure titanium and conventional corrosion-resistant titanium alloys are designated by Nos. 1 to 7. Ternary alloys prepared in accordance with the invention are represented by Nos. 8 through 51 and quaternary and further multicomponent alloys of the invention by Nos. 52 through 62.

Test material Nos. 8 to 13 are (Ti-Ru-Ni) alloys embodying the invention in which the Ni proportion was varied. A Ni content as small as 0.01 wt% (No. 8) proved effective, and the corrosion rate was sharply lowered with 0.1 wt% or more. The favorable effect of Ni addition is readily distinguishable by comparison with No. 3.

TABLE 1

Results of general corrosion tests (1% $H_2SO_4$, boiling)

| No. | Composition (wt %) | Corrosion rate (mm/y) |
|---|---|---|
| 1 | Pure titanium | 10.4 |
| 2 | Ti—0.15Pd | 0.278 |
| 3 | Ti—0.04Ru | 0.280 |
| 4 | Ti—0.6Ni | 6.55 |
| 5 | Ti—0.8Ni—0.3Mo | 1.69 |
| 6 | Ti—0.02W | 9.74 |
| 7 | Ti—0.1Mo | 9.42 |
| 8 | Ti—0.03Ru—0.01Ni | 0.271 |
| 9 | Ti—0.03Ru—0.06Ni | 0.156 |
| 10 | Ti—0.03Ru—0.12Ni | 0.078 |
| 11 | Ti—0.03Ru—0.6Ni | 0.060 |
| 12 | Ti—0.03Ru—1.0Ni | 0.059 |
| 13 | Ti—0.03Ru—2.0Ni | 0.054 |
| 14 | Ti—0.01Ru—0.6Ni | 0.085 |
| 15 | Ti—0.04Ru—0.6Ni | 0.076 |

TABLE 1-continued

| No. | Composition (wt %) | Corrosion rate (mm/y) |
|---|---|---|
| | Results of general corrosion tests (1% $H_2SO_4$, boiling) | |
| 16 | Ti—0.07Ru—0.6Ni | 0.075 |
| 17 | Ti—0.11Ru—0.6Ni | 0.069 |
| 18 | Ti—0.20Ru—0.6Ni | 0.058 |
| 19 | Ti—0.04Ru—0.01W | 0.241 |
| 20 | Ti—0.04Ru—0.05W | 0.144 |
| 21 | Ti—0.04Ru—0.1W | 0.108 |
| 22 | Ti—0.04Ru—0.5W | 0.089 |
| 23 | Ti—0.01Ru—0.02W | 0.271 |
| 24 | Ti—0.1Ru—0.02W | 0.073 |
| 25 | Ti—0.2Ru—0.02W | 0.066 |
| 26 | Ti—0.04Ru—0.01Mo | 0.231 |
| 27 | Ti—0.04Ru—0.3Mo | 0.177 |
| 28 | Ti—0.04Ru—1.0Mo | 0.192 |
| 29 | Ti—0.01Ru—0.1Mo | 0.275 |
| 30 | Ti—0.1Ru—0.1Mo | 0.177 |
| 31 | Ti—0.2Ru—0.1Mo | 0.100 |
| 32 | Ti—0.05Pd—0.01Ni | 0.266 |
| 33 | Ti—0.05Pd—0.1Ni | 0.093 |
| 34 | Ti—0.05Pd—1.0Ni | 0.071 |
| 35 | Ti—0.05Pd—2.0Ni | 0.069 |
| 36 | Ti—0.01Pd—0.6Ni | 0.275 |
| 37 | Ti—0.1Pd—0.6Ni | 0.062 |
| 38 | Ti—1.1Pd—0.6Ni | 0.033 |
| 39 | Ti—2.0Pd—0.6Ni | 0.029 |
| 40 | Ti—0.07Pd—0.005W | 0.253 |
| 41 | Ti—0.07Pd—0.09W | 0.194 |
| 42 | Ti—0.07Pd—0.5W | 0.188 |
| 43 | Ti—0.01Pd—0.05W | 0.271 |
| 44 | Ti—0.15Pd—0.05W | 0.143 |
| 45 | Ti—2.0Pd—0.05W | 0.033 |
| 46 | Ti—0.05Pd—0.01Mo | 0.199 |
| 47 | Ti—0.05Pd—0.3Mo | 0.188 |
| 48 | Ti—0.05Pd—1.0Mo | 0.176 |
| 49 | Ti—0.01Pd—0.1Mo | 0.272 |
| 50 | Ti—0.15Pd—0.1Mo | 0.231 |
| 51 | Ti—2.0Pd—0.1Mo | 0.084 |
| 52 | Ti—0.05Ru—0.5Ni—0.02W | 0.049 |
| 53 | Ti—0.05Ru—0.5Ni—0.1Mo | 0.045 |
| 54 | Ti—0.04Ru—0.02W—0.1Mo | 0.113 |
| 55 | Ti—0.05Pd—0.5Ni—0.02W | 0.077 |
| 56 | Ti—0.05Pd—0.5Ni—0.1Mo | 0.073 |
| 57 | Ti—0.04Pd—0.02W—0.1Mo | 0.094 |
| 58 | Ti—0.05Pd—0.05Ru—0.5Ni | 0.043 |
| 59 | Ti—0.05Pd—0.05Ru—0.5Mo | 0.101 |
| 60 | Ti—0.05Pd—0.05Ru—0.5W | 0.108 |
| 61 | Ti—0.05Ru—0.02W—0.1Mo—0.5Ni | 0.073 |
| 62 | Ti—0.05Pd—0.02W—0.1Mo—0.5Ni | 0.084 |

It should be clear from these why the lower limit was fixed at 0.01 wt%. The upper limit of 2.0 wt% is placed because a larger addition of Ni does not produce a correspondingly favorable effect but affects the workability of the alloy seriously.

Nos. 14 to 18 are (Ti-Ru-Ni) alloys embodying the invention with varied Ru proportions. A Ru content of only 0.01 wt% (No. 14) exhibited its beneficial effect. The effectiveness of Ru addition is obvious in contrast with No. 4. Thus, it will be appreciated that the lower limit is 0.005 wt%. The upper limit of 0.2 wt% for Ru addition is required since a higher percentage addition is little contributive to rise the anticorrosive effect for the added amount of unduly raises the Ru cost.

Nos. 19 to 22 represent (Ti-Ru-W) alloys according to the invention with varied W contents. The corrosion rate was noticeably retarded by the addition of 0.005 wt% (No. 19), demonstrating the advantage derived from the W addition over No. 3. Hence, the lower limit of 0.005 wt% for W addition. The upper limit of 0.5 wt% is chosen because more W seriously affects the workability of the alloy.

In Nos. 23 to 25, (Ti-Ru-W) alloys of the invention, the Ru content was varied. With 0.01 wt% Ru (No. 23) the favorable effect is evident, as contrasted with No. 6. Thus, the lower limit is 0.005 wt%. The upper limit of 0.2 wt% is necessary because more Ru does not give a marked effect but raise the Ru cost to excess.

Nos. 26 to 28 are (Ti-Ru-Mo) alloys embodying the invention with varied Mo contents. The corrosion rate began to slow down with 0.01 wt% Mo (No. 26), indicating the merit of Mo addition in contrast with No. 3. For this reason the lower limit of 0.01 wt% is put to Mo addition. The upper limit of 1.0 wt% is placed to avoid a larger Mo percentage which will reduce the workability of the resulting alloy.

In (Ti-Ru-Mo) alloys of the invention, only the Ru content was varied in Nos. 29 to 31. Ru addition evidently took its effect with only 0.01 wt% (No. 29), and its favorable effect makes a sharp contrast to No. 7. In view of this, the lower limit of Ru addition is set at 0.005 wt%. The upper limit is 0.2 wt% because a larger Ru content does not add an accordingly desirable effect but merely boosts the Ru cost.

Nos. 32 through 51 represent Ti-Pd alloys with the addition of Ni, Mo, or W in accordance with the invention. The data suggest practically the same tendency as observed with the Ru-containing alloys already described. In brief, the addition of Ni, Mo, or W remarkably improves the corrosion resistance of the Ti-Pd alloys.

Nos. 52 through 62 represent the alloys of four or more components embodying the invention. It must be understood that all are superior to conventional corrosion-resistant titanium alloys.

Table 2 shows the results of tests conducted using 5% HCl, boiling.

TABLE 2

| No. | Composition (wt %) | Corrosion rate (mm/y) |
|---|---|---|
| | Results of general corrosion tests (5% HCl, boiling) | |
| 1 | Pure titanium | 29.7 |
| 2 | Ti—0.11Pd | 6.20 |
| 3 | Ti—0.02Ru | 9.51 |
| 4 | Ti—0.6Ni | 83.3 |
| 5 | Ti—0.8Ni—0.3Mo | 71.7 |
| 6 | Ti—0.02W | 33.1 |
| 7 | Ti—0.1Mo | 44.6 |
| 8 | Ti—0.03Ru—0.01Ni | 5.39 |
| 9 | Ti—0.03Ru—0.06Ni | 2.20 |
| 10 | Ti—0.03Ru—0.12Ni | 0.685 |
| 11 | Ti—0.03Ru—0.6Ni | 0.579 |
| 12 | Ti—0.03Ru—1.0Ni | 0.504 |
| 13 | Ti—0.03Ru—2.0Ni | 0.498 |
| 14 | Ti—0.01Ru—0.6Ni | 0.479 |
| 15 | Ti—0.04Ru—0.6Ni | 0.390 |
| 16 | Ti—0.07Ru—0.6Ni | 0.331 |
| 17 | Ti—0.11Ru—0.6Ni | 0.360 |
| 18 | Ti—0.20Ru—0.6Ni | 0.299 |
| 19 | Ti—0.04Ru—0.01W | 0.352 |
| 20 | Ti—0.04Ru—0.05W | 0.291 |
| 21 | Ti—0.04Ru—0.1W | 0.203 |
| 22 | Ti—0.04Ru—0.5W | 0.194 |
| 23 | Ti—0.01Ru—0.02W | 5.88 |
| 24 | Ti—0.1Ru—0.02W | 0.933 |
| 25 | Ti—0.2Ru—0.02W | 0.428 |
| 26 | Ti—0.04Ru—0.01Mo | 1.98 |
| 27 | Ti—0.04Ru—0.3Mo | 1.03 |
| 28 | Ti—0.04Ru—1.0Mo | 1.41 |
| 29 | Ti—0.01Ru—0.1Mo | 6.07 |
| 30 | Ti—0.1Ru—0.1Mo | 1.32 |
| 31 | Ti—0.2Ru—0.1Mo | 0.75 |
| 32 | Ti—0.05Pd—0.01Ni | 5.01 |
| 33 | Ti—0.05Pd—0.13Ni | 0.543 |
| 34 | Ti—0.05Pd—1.0Ni | 0.495 |
| 35 | Ti—0.05Pd—2.0Ni | 0.426 |

TABLE 2-continued

| Results of general corrosion tests (5% HCl, boiling) | | |
|---|---|---|
| No. | Composition (wt %) | Corrosion rate (mm/y) |
| 36 | Ti—0.01Pd—0.6Ni | 3.47 |
| 37 | Ti—0.1Pd—0.6Ni | 0.378 |
| 38 | Ti—1.1Pd—0.6Ni | 0.141 |
| 39 | Ti—2.0Pd—0.6Ni | 0.093 |
| 40 | Ti—0.07Pd—0.005W | 2.88 |
| 41 | Ti—0.07Pd—0.09W | 1.31 |
| 42 | Ti—0.07Pd—0.5W | 1.07 |
| 43 | Ti—0.01Pd—0.05W | 6.34 |
| 44 | Ti—0.15Pd—0.05W | 0.883 |
| 45 | Ti—2.0Pd—0.05W | 0.691 |
| 46 | Ti—0.05Pd—0.01Mo | 7.03 |
| 47 | Ti—0.05Pd—0.3Mo | 5.32 |
| 48 | Ti—0.05Pd—1.0Mo | 4.37 |
| 49 | Ti—0.01Pd—0.1Mo | 6.43 |
| 50 | Ti—0.15Pd—0.1Mo | 1.03 |
| 51 | Ti—2.0Pd—0.1Mo | 0.745 |
| 52 | Ti—0.05Ru—0.5Ni—0.02W | 1.94 |
| 53 | Ti—0.05Ru—0.5Ni—0.1Mo | 1.88 |
| 54 | Ti—0.04Ru—0.02W—0.1Mo | 1.91 |
| 55 | Ti—0.05Pd—0.5Ni—0.02W | 2.00 |
| 56 | Ti—0.05Pd—0.5Ni—0.1Mo | 2.03 |
| 57 | Ti—0.04Pd—0.02W—0.1Mo | 2.21 |
| 58 | Ti—0.05Pd—0.05Ru—0.5Ni | 0.355 |
| 59 | Ti—0.05Pd—0.05Ru—0.5Mo | 0.703 |
| 60 | Ti—0.05Pd—0.05Ru—0.5W | 0.817 |
| 61 | Ti—0.05Ru—0.02W—0.1Mo—0.5Ni | 0.221 |
| 62 | Ti—0.05Pd—0.02W—0.1Mo—0.5Ni | 0.296 |

The corrosive environment was more rigorous than with 1% $H_2SO_4$ and the corrosion rates were generally higher. However, the alloys embodying the invention all remained superior to the ordinary corrosion-resistant titanium alloys.

Crevice corrosion tests were conducted and the results as in Table 3 were obtained.

As the corrosive conditions, an aqueous solution of 10% sodium chloride was used, with pH=6.1 in a boiling state.

Crevice corrosion occurred in pure titanium and a Ti-0.15Pd alloy before the lapse of one full day. A Ti-0.8Ni-0.3Mo alloy corroded in two days. The alloys embodying the invention, by contrast, were all more resistant to crevice corrosion. It will be seen from the table that the alloys according to the invention are superior in resistance to crevice corrosion as well as to general corrosion.

Aside from the resistance to the afore-described corrosive attacks, the alloys according to the invention have excellent resistance to hydrogen absorption. Table 4 gives the results of tests on this subject.

The data were obtained from tests performed using platinum as the counter electrode and a bath voltage of 6 V and then allowing the test material to absorb hydrogen from hydrogen bubbles formed and directed to the alloy surface. The table clearly indicates that the alloys of the invention absorbed less hydrogen than pure titanium does.

TABLE 3

| Results of crevice corrosion tests (NaCl = 10%, pH = 6.1, boiling) | | | | | | |
|---|---|---|---|---|---|---|
| No. | Composition (wt %) | 1 | 2 | 3 | 4 | (day) |
| Comparative alloy | | | | | | |
| 1 | Pure titanium | X | X | X | X | |
| 2 | Ti—0.15Pd | X | X | X | X | |
| 3 | Ti—0.05Ru | Δ | X | X | X | |
| 4 | Ti—0.8Ni—0.3Mo | O | Δ | X | X | |
| 5 | Ti—0.02W | X | X | X | X | |
| 6 | Ti—0.1Mo | X | X | X | X | |
| 7 | Ti—0.6Ni | O | X | X | X | |
| 8 | Ti—0.05Ru—0.5Ni | O | O | O | O | |
| 9 | Ti—0.05Ru—0.05W | O | O | Δ | X | |
| 10 | Ti—0.05Ru—0.1Mo | O | O | X | X | |
| 11 | Ti—0.05Pd—0.5Ni | O | O | O | O | |
| 12 | Ti—0.05Pd—0.05W | O | O | Δ | X | |
| 13 | Ti—0.05Pd—0.1Mo | O | O | Δ | X | |
| 14 | Ti—0.05Ru—0.5Ni—0.02W | O | O | O | O | |
| 15 | Ti—0.05Ru—0.5Ni—0.1Mo | O | O | O | O | |
| 16 | Ti—0.05Ru—0.02W—0.1Mo | O | O | O | Δ | |
| 17 | Ti—0.05Pd—0.5Ni—0.02W | O | O | O | O | |
| 18 | Ti—0.05Pd—0.5Ni—0.1Mo | O | O | O | O | |
| 19 | Ti—0.05Pd—0.02W—0.1Mo | O | O | O | X | |
| 20 | Ti—0.05Ru—0.02W—0.1Mo—0.5Ni | O | O | O | O | |
| 21 | Ti—0.05Pd—0.02W—0.1Mo—0.5Ni | O | O | O | O | |

O: No change
Δ: Color change
X: Crevice corrosion

TABLE 4

| Results of hydrogen absorption tests | | |
|---|---|---|
| | | Item |
| Condition | Test material | $H_2$ conc. increased by $H_2$ abspn. (wt %) |
| 6 v × 3 hours (25° C.) | Pure titanium | 0.0040 |
| | Ti—0.05Ru—0.5Ni | 0.0001 |
| | Ti—0.05Ru—0.01W | 0.0007 |
| | Ti—0.05Ru—0.05Mo | 0.0013 |
| | Ti—0.05Pd—0.5Ni | 0.0001 |
| | Ti—0.05Pd—0.01W | 0.0009 |
| | Ti—0.05Pd—0.05Mo | 0.0006 |
| 6 v × 24 hours (15° C.) | Pure titanium | 0.0059 |
| | Ti—0.05Ru—0.5Ni | 0.0004 |
| | Ti—0.05Ru—0.01W | 0.0013 |
| | Ti—0.05Ru—0.05Mo | 0.0030 |
| | Ti—0.05Pd—0.5Ni | 0.0005 |
| | Ti—0.05Pd—0.01W | 0.0017 |
| | Ti—0.05Pd—0.05Mo | 0.0036 |

As has been described hereinbefore, the alloy according to this invention is strongly resistant to such highly corrosive non-oxidizing acids as sulfuric acid. It also possesses excellent resistance to crevice corrosion and hydrogen absorption. The proportions of the alloying elements added are small enough for the alloy to be worked almost as easily as pure titanium and made at low cost. It will be understood from these that the alloy of the invention is a novel titanium alloy that eliminates the disadvantages of the existing corrosion-resistant titanium alloys and exhibits greater corrosion resistance.

What is claimed is:

1. An excellently corrosion-resistant titanium-base alloy consisting essentially of, all by weight, either from 0.005% to less than 0.2% ruthenium or from 0.005% to 2.0% palladium or both, at least one of from 0.01% to 2.0% nickel, from 0.005% to 0.5% tungsten, and from 0.01% to 1.0% molybdenum, and the remainder titanium and unavoidable impurities.

* * * * *